US006899187B1

(12) United States Patent
McCarthy

(10) Patent No.: US 6,899,187 B1
(45) Date of Patent: May 31, 2005

(54) HOLLOW POLE DRIVER

(76) Inventor: Michael Partick McCarthy, 210-21st Ter. SE, Largo, FL (US) 33771

( * ) Notice: Subject to any disclaimer, the term of this patent is extended or adjusted under 35 U.S.C. 154(b) by 764 days.

(21) Appl. No.: 09/302,714

(22) Filed: Apr. 30, 1999

(51) Int. Cl.[7] ..... E21B 4/06
(52) U.S. Cl. ..... 175/19; 135/99
(58) Field of Search ..... 175/19, 18, 414; 173/90, 91; 405/232, 245, 246; 135/65, 77, 99

(56) References Cited

U.S. PATENT DOCUMENTS 2,572,370 A * 10/1951 Moeller
2,629,985 A * 3/1953 McDowell ..... 173/91
2,742,226 A * 4/1956 Voelkerding ..... 173/91
2,759,486 A * 8/1956 Pesaturo ..... 173/91
3,143,817 A * 8/1964 Paulson ..... 40/125
3,519,234 A * 7/1970 Matson ..... 173/91
4,101,088 A * 7/1978 Stauth ..... 242/85
4,261,424 A * 4/1981 Gonterman et al. ..... 173/91
4,431,040 A * 2/1984 Friedrich et al. ..... 144/193 C
4,483,058 A * 11/1984 Clutter et al.
4,703,549 A * 11/1987 Grandt
4,836,232 A * 6/1989 De Rosa et al. ..... 135/99
5,495,878 A * 3/1996 McKenen, Jr. ..... 144/193 C
5,671,814 A * 9/1997 Smith ..... 173/91
5,699,864 A * 12/1997 Dvorak et al. ..... 173/91
5,722,205 A 3/1998 Gannaway
5,768,785 A * 6/1998 Pessin ..... 30/164.6
5,848,712 A * 12/1998 Weir ..... 211/107

* cited by examiner

*Primary Examiner*—William Neuder
(74) *Attorney, Agent, or Firm*—Larson & Larson, PA; Herbert W. Larson

(57) ABSTRACT

A hollow pole has an open top end and a pointed bottom end; the open top end supports an additional pole. A ring member is permanently mounted about a mid-section of the hollow pole. A hammer sleeve having a length less than that of the hollow pole inserts over the hollow pole and around the ring member. A pair of weights are mounted within opposed ends of the hammer sleeve and surrounds the ring member. The ring member provides an upper and lower limit to the hammer sleeve. With the pointed bottom end of the hollow pole positioned on the ground, the hammer sleeve is pulled upward and slammed downward driving the pole into the ground. To remove the pole, the procedure is reversed whereby the hammer sleeve is slammed upwards away from the ground. The additional pole can support a plurality of different items, such as, for example, a beach umbrella or an attachment to a volley ball net.

20 Claims, 4 Drawing Sheets

HOLLOW POLE DRIVER

BACKGROUND OF THE INVENTION

1. Field of the Invention

This invention relates to a pole driver. More particularly, it relates to a device for attaching to a hollow pole for driving the pole into the ground and removing it therefrom.

2. Description of Prior Art

Depending on the hardness of any given ground surface, the driving of a pole into the ground can be difficult. If an individual merely uses human applied force, the pole may not be driven to the desired depth. If the pole is solid, it is known that an individual can strike the top portion of the pole with a hammer to apply the necessary force for driving the pole to the desired depth. Unfortunately, the use of a hammer on a hollow pole may result in damage to the hollow pole. For instance, if the pole is a lightweight and hollow pole used for recreational use, such as, for example, a beach umbrella, the use of a hammer to strike the top portion of the hollow umbrella pole will most certainly lead to damage thereof. In particular, the pole will crimp and bend.

It would therefore be desirable to provide a means for driving/inserting a hollow pole into a ground surface. Such device should not require the application of force to its top end thereby avoiding damage of the hollow pole. A mechanism attached to the pole which applies force about the mid-section of the pole would be desirable. Further, the mechanism should permit the user to remove the hollow pole with the same amount of ease.

Applicant is not aware of any such device for use with hollow poles, and more specifically any such device for use with driving and removing recreational-type hollow poles into and from the ground. Applicant is aware of industrial devices, such as those seen in U.S. Pat. No. 2,572,370 to Moeller, U.S. Pat. No. 4,483,058 to Clutter et al. and U.S. Pat. No. 4,703,549 to Grandt which disclose hammer impact tools. More particularly, Grandt discloses a hammer impact tool for stripping or separating a form wall from a poured concrete foundation wall and for pulling wheels and bearings. Clutter et al. discloses a device having a pair of opposed, shiftable jaws at a first end and a hammer impact means at a second and opposed end for removing and installing electrical connector elbows or other items relating to energized electrical equipment. Moeller discloses an impact tool having an integral flange formed in the top end of the pole which permits an interchangeable element to be attached to an opposed bottom end such that device can act as a valve puller, tuner, rotator, spanner or screw driver. None of these devices contemplate the use of a mid-mounted impact mechanism for driving recreational-type hollow poles into the ground.

SUMMARY OF THE INVENTION

I have invented a device for mounting to a hollow pole to assist in driving the hollow pole into the ground and for subsequently assisting in the removal thereof. My device can be used with any recreational-type hollow pole, such as, for example, a beach or yard umbrella, volley ball net poles and other similar recreational-type hollow poles.

My device includes a ring permanently mounted to the hollow pole in a generally mid-section of the pole, a hammer sleeve for sliding over the pole and ring, and a pair of weights (top and bottom) mounted within the hammer sleeve at opposed sides of the ring. The hammer sleeve slides about the axis of the pole in two opposed directions. Depending on the direction of force being applied, the hammer sleeve is stopped by the weights striking a respective side of the ring. Downward force assists in the insertion of the hollow pole into the ground, whereas upward force assists in the removal of the hollow pole from the ground. Since the mechanism is enclosed within the hammer sleeve, injury is avoided in that no pinching of the skin of the user will occur when the weights are striking the stop ring.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
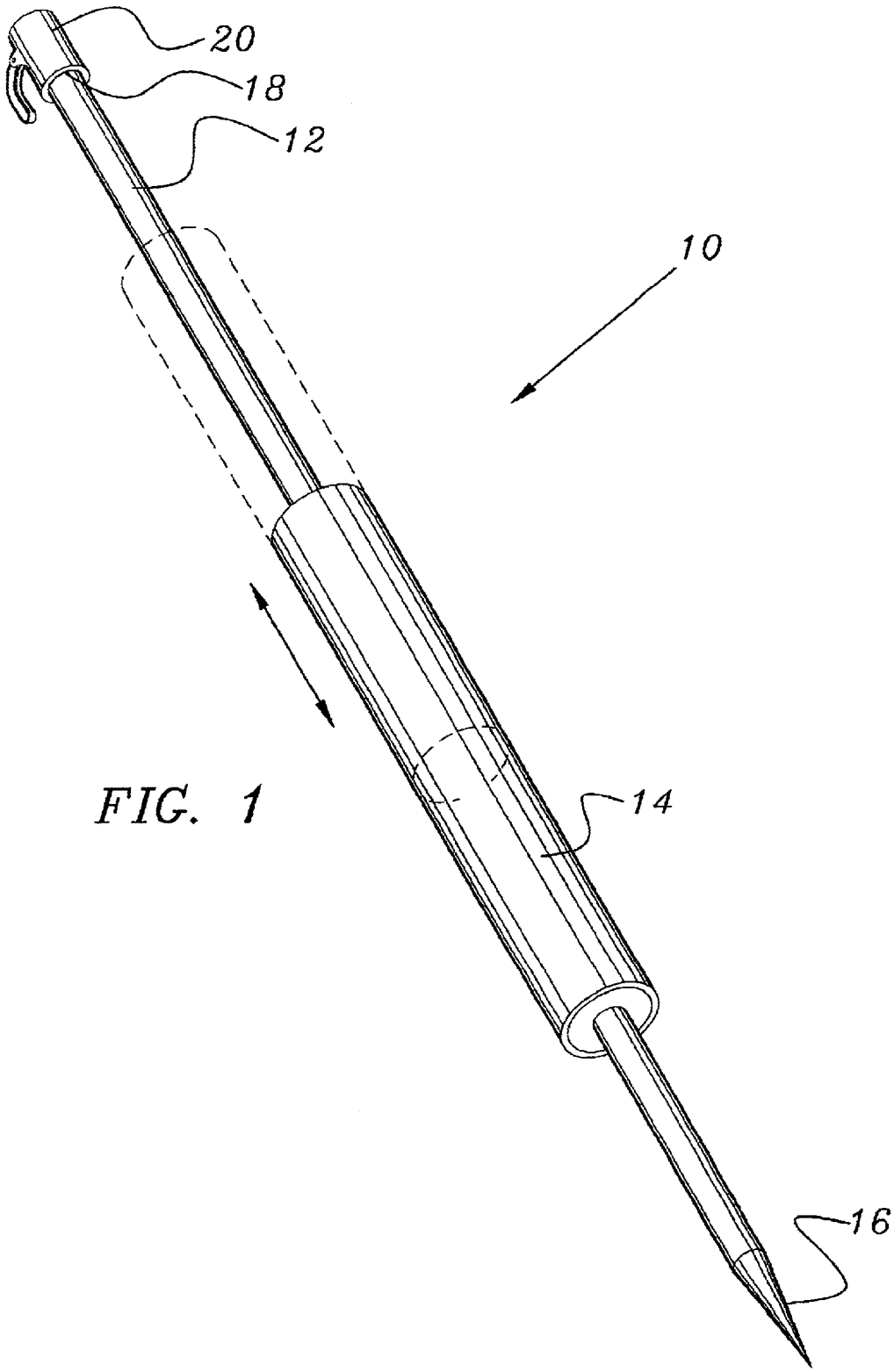
FIG. 1 is a perspective view of a POLE DRIVER of the present invention, the broken lines illustrating how an outer cylindrical housing moves along the axis of a pole.

Throughout the following detailed description, the same reference numerals refer to the same elements in all figures.

Figure 7:
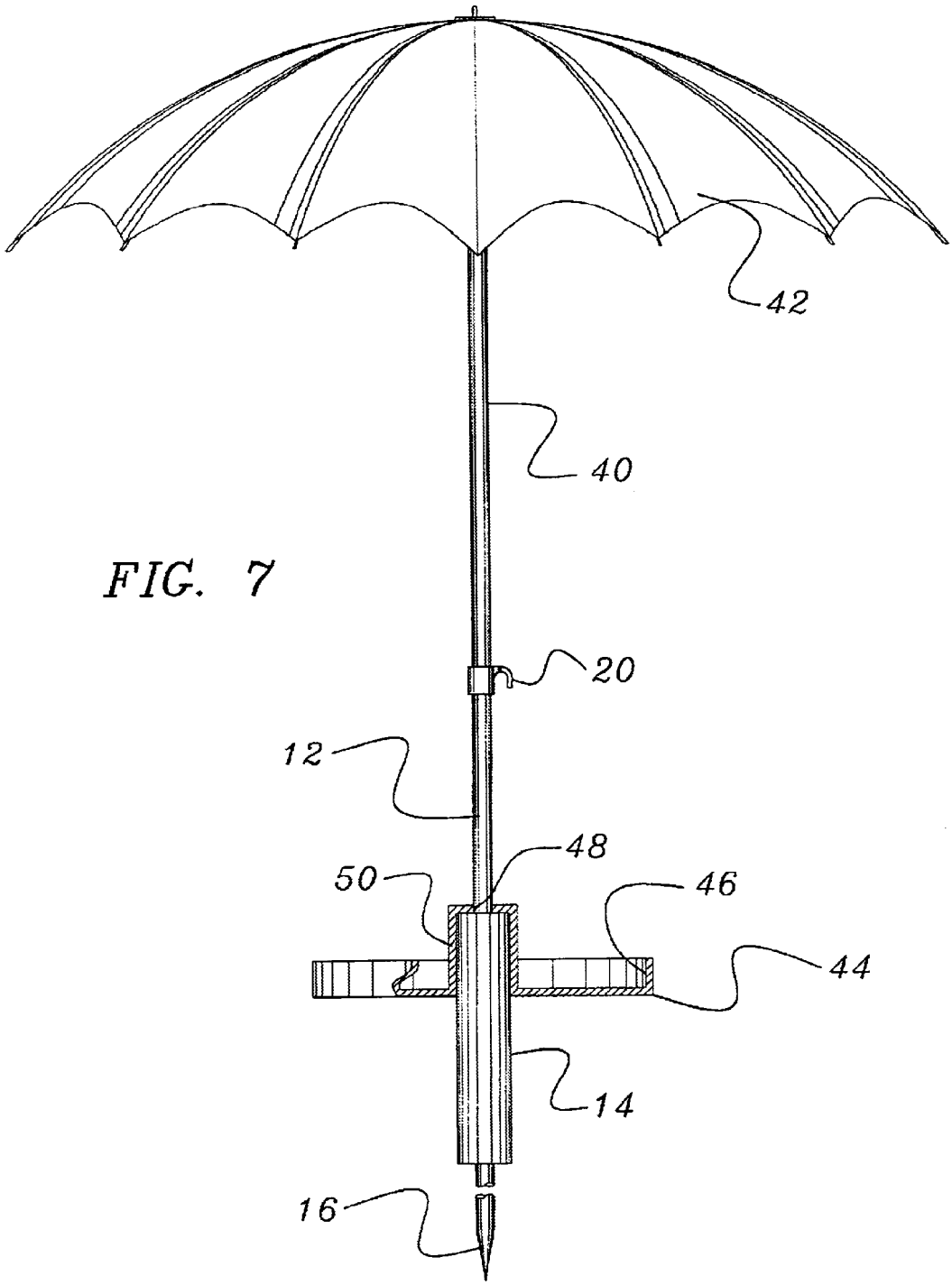
FIG. 7 is a side elevational view of the device of the present invention illustrating alternate attachments.

Referring to FIG. 1, the hollow pole driver device 10 of the present invention is shown. Driver 10 includes a hollow pole 12 and a hammer sleeve 14. Pole 12 has an outer circumference less than and a length greater than that of hammer sleeve 14. Both pole 12 and hammer sleeve 14 are cylindrical in shape. In the preferred embodiment, driver 10 is used with beach or yard umbrellas. Accordingly to the preferred embodiment, driver 10 further includes a pointed bottom end 16 for inserting within the ground and a cylindrically-shaped top end 18 having a clamping mechanism 20 inserted thereon. Referring to FIG. 7, clamping mechanism 20 permits an additional pole 40 to be inserted into and supported by driver device 10 once hollow pole 12 is driven into the ground to the desired depth. Additional pole 40 can support a plurality of different items, such as, for example an umbrella portion 42 mounted thereon. Alternate embodiments do not require the use of the clamping mechanism 20 and support additional pole 40 by means of a friction fit or a "pop-out" tab locking mechanism (neither shown herein). Further, alternate embodiments are used with other recreational-type devices, such as, for example, volley ball nets. In the preferred embodiment, clamping mechanism 20 fits on hollow pole top end 18 by a friction fit. Although alternate embodiments permit clamping mechanism to attach to hollow pole top end 18 by other means, such as, for example, a threaded engagement.

Figure 2:
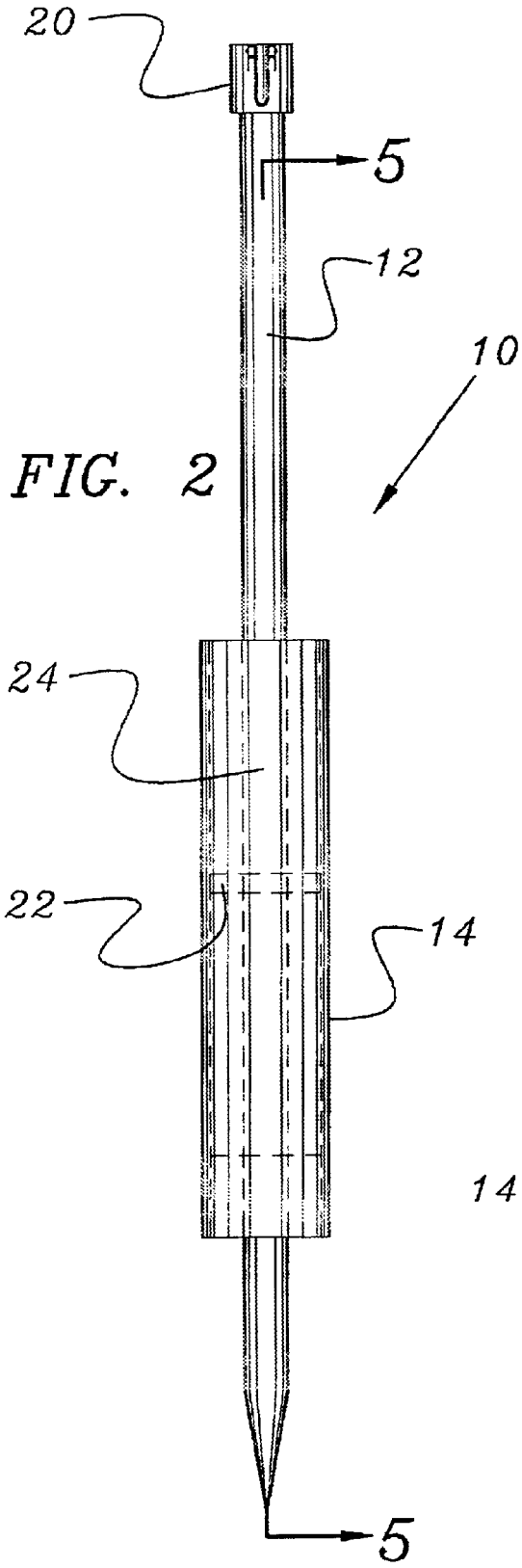
FIG. 2 is a side elevational view of the device of the present invention.
Figure 3:
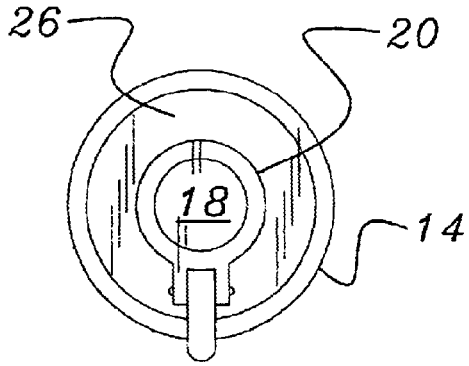
FIG. 3 is a top view of the device of the present invention.
Figure 4:
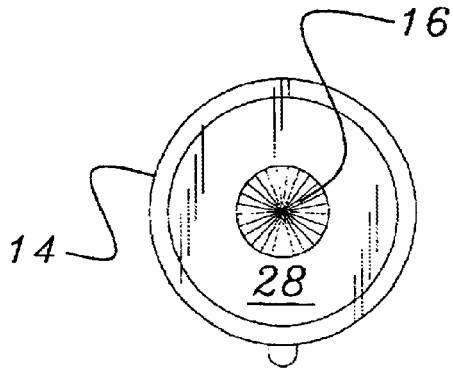
FIG. 4 is a bottom view of the device of the present invention.

Referring to FIG. 2, hollow pole driver 10 further includes a cylindrically-shaped stop ring 22 mounted generally about a mid-section 24 of pole 12. Ring 22 is toroid shaped having a center opening formed therein. The center opening has a circumference generally equal to that of the outer circumference of pole 12. In the preferred embodiment, ring 22 is welded to pole 12 although alternate means of attachment could be employed. Further, to the preferred embodiment, ring 22 is schedule 40 pipe (wall thickness).

Figure 5:
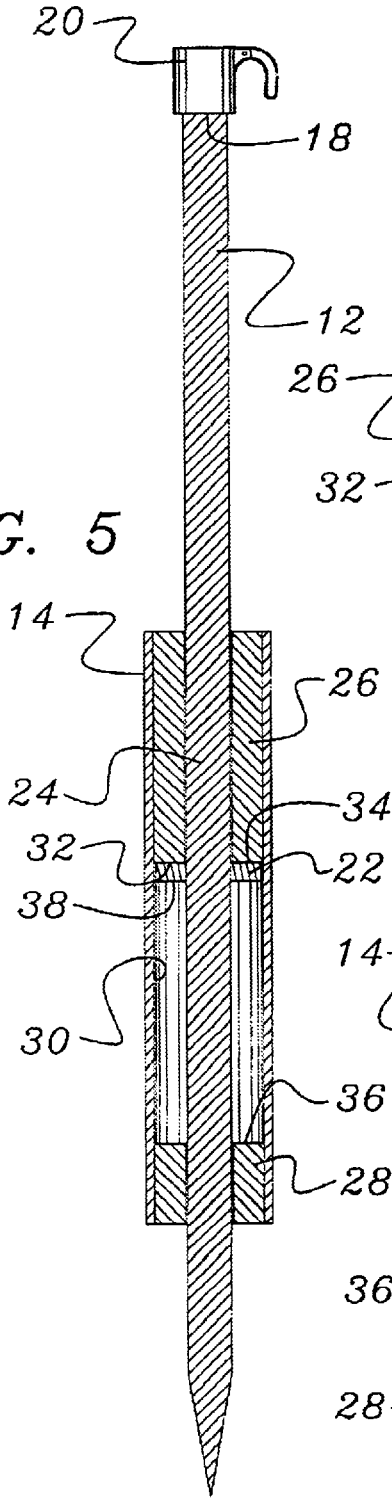
FIG. 5 is a sectional view of the device of the present invention along lines 5—5 of FIG. 2.

Referring to FIG. 5, a top and bottom weight, 26 and 28 respectively, are mounted within hammer sleeve 14. In the preferred embodiment, weights 26 and 28 are welded to an inner surface 30 of hammer sleeve 14 and have an outer circumference generally equal to a circumference of inner surface 30. In an alternate embodiment, weights 26 and 28 are threaded and engage threads provided along inner surface 30 of hammer sleeve 14. In the preferred embodiment, ring 22 is 0.5" thick, bottom weight 28 is 1.5" thick and top weight 26 is 3.0" thick. Accordingly, top weight 26 has a larger mass than bottom weight 28 which in turn has a larger mass than ring 22.

Further to FIG. 5, top weight 26 has a bottom surface 32 for striking a top surface 34 of ring 22 when pole driver 10 is employed to drive pole 12 into the ground. More particularly, with pointed bottom end 16 of pole 12 positioned on the ground where the user wishes to insert pole 12, hammer sleeve 14 is gripped, pulled upward and slammed downward towards the ground. When bottom surface 32 of top weight 26 strikes top surface 34 of ring 22, force is applied in the downward axial direction of pole 12, forcing pole 12 into the ground. Depending on the hardness of the ground to which pole 12 is being inserted, and the desired depth, the aforementioned procedure is repeated. Once pole 12 reaches its desired depth, the additional pole, if used, can be inserted into pole 12 at top end 18.

With continuing reference to FIG. 5, bottom weight 28 has a top surface 36 for striking a bottom surface 38 of ring 22 when pole driver 10 is employed to remove pole 12 from the ground. More particularly, when pole 12 is to be removed, any additional poles are first removed from top end 18 of pole 12. Hammer sleeve 14 is then gripped and slammed upward away from the ground. When top surface 36 of bottom weight 28 strikes bottom surface 38 of ring 22, force is applied in the upward axial direction of pole 12, forcing pole 12 from the ground. Again, depending on the hardness of the ground from which pole 12 is being removed, and the depth of insertion of pole 12, the aforementioned procedure is repeated until pole 12 is fully removed from the ground.

Figure 6:
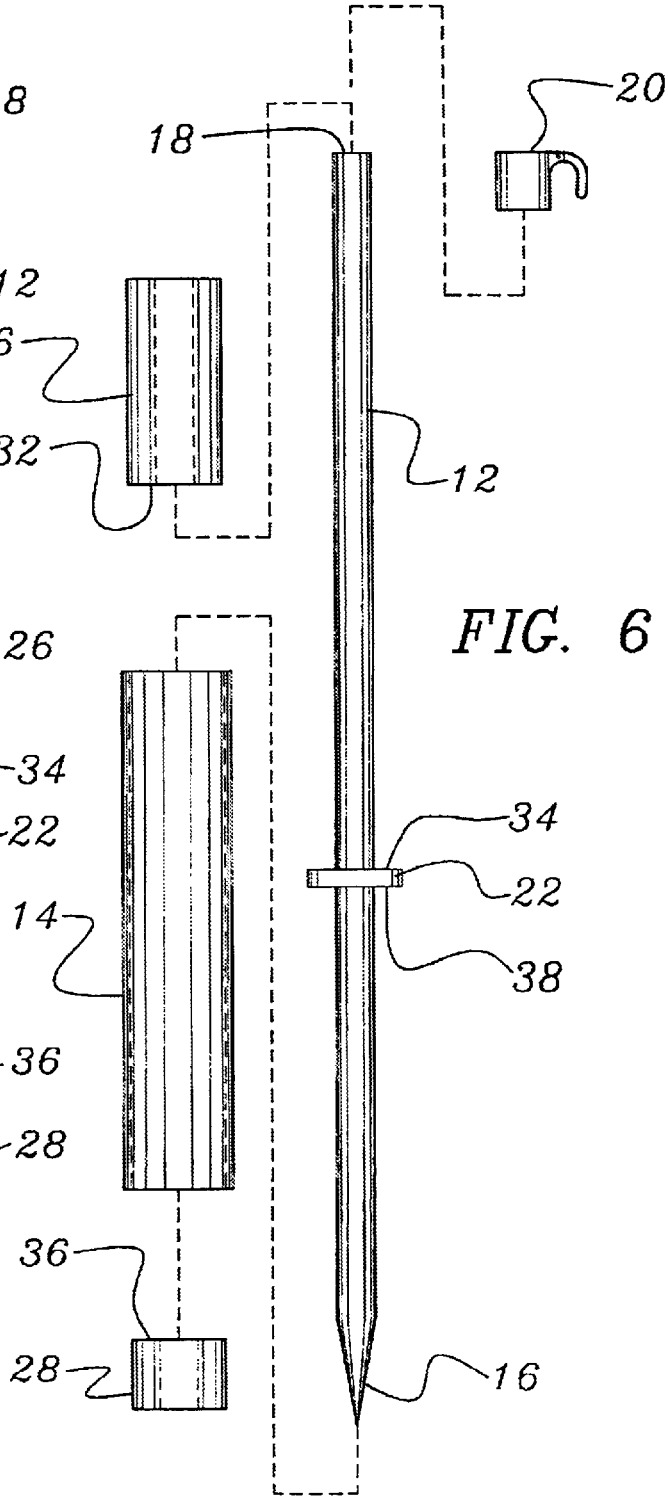
FIG. 6 is an exploded view of the device of the present invention.

Referring to FIG. 6, an exploded view of hollow pole driver device 10 of the present invention is shown. To construct the device, ring 22 is first mounted to pole 12. Thereafter, one of the two weights, 26 or 28, is mounted within hammer sleeve 14 (FIG. 6 illustrates bottom weight 28 being the first weight to mount, although top weight 26 could be the first to mount). Hammer sleeve 14 with one of the weights mounted therein is then inserted over pole 12 until the weight rests against ring 22. Finally, the other weight is mounted within hammer sleeve 14 such that ring 22 is enclosed within hammer sleeve 14 and surrounded by top and bottom weights, 26 and 28 respectively.

Referring to FIG. 7, an alternate attachment is shown. In particular, a tray 44 can be inserted over pole 12 after pole 12 is driven into the ground. In the preferred embodiment, tray 44 is circular in shape and has an upward extending wall 46 for retaining articles therewithin. An aperture 48 is formed through a top surface of a column portion 50 extending upward in a generally mid-section of tray 44. Aperture 48 permits tray 44 to be inserted over pole 12. Aperture 48 has a circumference generally equal to that of the hollow pole outer circumference thereby providing a friction fit for tray 44. Further, tray 44 sits on top of hammer sleeve 14 at the hammer sleeve top end when tray 44 is employed and in its resting position. In the preferred embodiment, tray 44 should be inserted over pole 12 before clamping mechanism 20 is attached to pole 12.

Equivalent elements can be substituted for the ones set forth above such that they perform the same function in the same way for achieving the same result.

Having thus described the invention what is claimed and desired to be secured by Letters Patent is:

1. An impact tool in combination with a hollow pole comprising:

a) the hollow pole having a top and bottom end and a mid-section, b) an annular ring member having a top and bottom surface and an annular outer circumference, the annular ring member mounted to the hollow pole at the mid-section, c) the impact tool consisting of a cylindrically shaped hammer sleeve having open top and bottom ends, a center channel and an annular inner surface, the annular inner surface having an annular circumference greater than that of the annular ring member annular outer circumference, and d) first and second weight members mounted within the hammer sleeve center channel through the open top and bottom ends respectively, the first and second weight members on opposed sides of the annular ring member and providing an upper and lower limit to the hammer sleeve sliding axially around the hollow pole, the first weight member impacting the top surface of the annular ring member on a downward stroke of the hammer sleeve to drive the hollow pole downwardly into a ground surface and the second weight member impacting the bottom surface of the annular ring member on an upward stroke of the hammer sleeve to move the hollow pole upwardly from the ground.

2. The impact tool and hollow pole according to claim 1, wherein the hollow pole top end is cylindrically shaped and open and the hollow pole bottom end is pointed and closed.

3. The impact tool and hollow pole according to claim 2, wherein an additional pole is inserted within the hollow pole open top end.

4. The impact tool and hollow pole according to claim 3, further comprising a clamping means for securing the additional pole to the hollow pole, the clamping means mounted to the hollow pole open top end.

5. The impact tool and hollow pole according to claim 3, wherein the additional pole supports an umbrella portion.

6. The impact tool and hollow pole according to claim 1, wherein the ring member is welded to the hollow pole.

7. The impact tool and hollow pole according to claim 1, wherein the ring member has a mass less than that of the bottom weight.

8. The impact tool and hollow pole according to claim 7, wherein the bottom weight has a mass less than that of the top weight.

9. The impact tool and hollow pole according to claim 1, wherein the first and second weight members are cylindrically shaped and have an outer circumference generally equal to that of the hammer sleeve inner surface circumference.

10. The impact tool and hollow pole according to claim 9, wherein the first and second weight members are welded to the hammer sleeve inner surface.

11. The impact tool and hollow pole according to claim 1, further comprising:

a) a first set of threads provided on the hammer sleeve inner surface, b) a second set of threads provided on each of the first and second weight members, and c) the first set of threads for engaging the second set of threads for mounting the first and second weight members within the hammer sleeve center channel.

12. The impact tool and hollow pole according to claim 1, further comprising:

a) the ring member having planar top and bottom surfaces, b) the first weight member having a planar bottom surface, c) the second weight member having a planar top surface, d) the first weight member planar bottom surface striking the ring member planar top surface when force is applied to the hammer sleeve in an axial direction of the hollow pole towards the hollow pole bottom end, and e) the second weight member planar top surface striking the ring member planar bottom surface when force is applied to the hammer sleeve in an axial direction of the hollow pole away from the hollow pole bottom end.

13. An impact tool in combination with a hollow pole the hollow pole for supporting an additional pole, the impact tool permanently mounted to the hollow pole, the combination comprising:

a) the hollow pole having a cylindrically shaped open top end, a closed pointed bottom end and a mid-section, the open top end receiving the additional pole, the closed pointed end for penetrating the ground, b) an annular ring member having an annular outer circumference, a planar top surface and a planar bottom surface, the annular ring member permanently mounted to the hollow pole mid-section, c) the impact tool consisting of a cylindrically shaped hammer sleeve having a center channel and an annular inner surface, the annular inner surface having an annular circumference greater than that of the annular ring member annular outer circumference, and d) first and second cylindrically shaped weight members mounted within the hammer sleeve center channel the first and second weight members surrounding the annular ring member and providing an upper and lower limit to the hammer sleeve.

14. The impact tool and hollow pole according to claim 13, further comprising a clamping means for securing the additional pole to the hollow pole, the clamping means mounted to the hollow pole open top end.

15. The impact tool and hollow pole according to claim 14, wherein the additional pole supports an umbrella portion.

16. The impact tool and hollow pole according to claim 13, wherein the ring member has a mass less than that of the bottom weight.

17. The impact tool and hollow pole according to claim 16, wherein the bottom weight has a mass less than that of the top weight.

18. The impact tool and hollow pole according to claim 13, further comprising a circular tray portion having an upwardly extending wall positioned around an outer circumference of the tray, an upwardly extending column portion located at a center portion of the tray and an aperture formed through a top surface of the column portion, the aperture for receiving the hollow pole such that tray sits on a top end of the hammer sleeve when the tray is in a resting position.

19. The impact tool and hollow pole according to claim 13, further comprising:

a) a first set of threads provided on the hammer sleeve inner surface, b) a second set of threads provided on each of the first and second weight members, and c) the first set of threads for engaging the second set of threads for mounting the first and second weight members within the hammer sleeve center channel.

20. The impact tool and hollow pole according to claim 13, further comprising:

a) the first weight member having a planar bottom surface, b) the second weight member having a planar top surface, c) the first weight member planar bottom surface striking the ring member planar top surface when force is applied to the hammer sleeve in an axial direction of the hollow pole towards the hollow pole bottom end, and d) the second weight member planar top surface striking the ring member planar bottom surface when force is applied to the hammer sleeve in an axial direction of the hollow pole away from the hollow pole bottom end.

* * * * *